US005915978A

United States Patent [19]

Hayakawa et al.

[11] Patent Number: 5,915,978

[45] Date of Patent: Jun. 29, 1999

[54] JUNCTION BOX

[75] Inventors: Tatsuya Hayakawa; Tsutomu Naitou, both of Yokkaichi, Japan

[73] Assignee: Sumitomo Wiring Systems, Ltd., Japan

[21] Appl. No.: 08/901,438

[22] Filed: Jul. 28, 1997

Related U.S. Application Data

[63] Continuation of application No. 08/539,736, Oct. 5, 1995, abandoned.

[30] Foreign Application Priority Data

Dec. 15, 1994 [JP] Japan ..... 6-334151

[51] Int. Cl.[6] ..... H01R 9/09

[52] U.S. Cl. ..... 439/76.2; 439/621; 439/717; 439/949

[58] Field of Search ..... 439/76.2, 621, 439/622, 717, 532, 949

[56] References Cited

U.S. PATENT DOCUMENTS

| | | | |
|---|---|---|---|
| 4,171,862 | 10/1979 | Krasser | 439/717 |
| 4,469,393 | 9/1984 | Chewning, Jr. et al. | 439/717 |
| 4,767,339 | 8/1988 | Comerci | 439/717 |
| 5,403,193 | 4/1995 | Ito et al. | 439/76.2 |
| 5,478,244 | 12/1995 | Maue et al. | 439/76.2 |
| 5,507,077 | 4/1996 | Kotajima | 439/532 |

*Primary Examiner*—Gary Paumen
*Attorney, Agent, or Firm*—Jordan B. Bierman; Beirman, Muserlian and Lucas

[57] ABSTRACT

A junction box whose total size is reduced without reducing the areas necessary for accommodating fuse receptacles and relay receptacles. The body of the junction box is preferably a flat rectangular parallelepiped. On the first face thereof, there are integral relay receptacles, preferably adjacent one side in a single vertical row. On the opposite face, there is a plurality of fuse receptacles located adjacent the opposite side of the junction box and thereby spaced apart laterally from the relay receptacles. Those fuses which are relatively near to the relay receptacles are for apparatus which is not operated continuously, such as a rear windshield wiper, cigarette lighter, etc. On the four sides of the body are provided the locking members with which the junction box is fixed to the base, usually the chassis of an automotive vehicle.

13 Claims, 5 Drawing Sheets

JUNCTION BOX

This Application is a continuation of U.S. patent application Ser. No 08/539,736, now abandoned, Gary Pauman filed Oct. 5, 1995 which, in turn, claims the priority of Japanese Application 6-334151, filed Dec. 15, 1994.

The present Invention relates to a junction box having fuse receptacles and relay receptacles integral with its body. The Invention will be described with relation to an automotive vehicle, but is not limited thereto.

BACKGROUND OF THE INVENTION

A known conventional junction box is shown in FIG. 5. The conductive portion is an electroconductive plate in flat body 1, the lower face of which is to be affixed to a vehicle. On the upper face, remote from the lower face, there is provided a plurality of fuse receptacles 2, a plurality of fuse holders, relay receptacles 3 adapted to receive a connector-integrated relay (not shown), and connector 4 for connecting the junction box to another circuit.

However, the foregoing construction has some disadvantages. Due to the fact that fuse receptacles 2, relay receptacles 3, and connector 4, must be arranged in the same plane, the whole body 1 is required to be large, and no reduction in size can be achieved. To attempt to miniaturize the junction box, it was thought advisable, for example, to make fuse receptacles 2 small and increase the density thereof, thereby reducing the area occupied thereby. However, such an arrangement makes it very difficult to replace the fuses and is, therefore, not desirable. Further, reducing the area of relay receptacles 3 is naturally limited by sizes of the relays.

SUMMARY OF THE INVENTION

Accordingly, it is an object of the present Invention to provide a junction box which can be reduced in size while maintaining the necessary areas for the fuse receptacles and the relay receptacles. In the junction box of the present Invention, the electroconductive section is provided in the body, together with a plurality of fuse receptacles and relay receptacles which are integrally formed with the body. The various faces and sides of the box are at angles other than 0° and 180° to each other. The fuse receptacles and the relay receptacles are on the lower face and the upper face of the box, respectively.

Thus, locking members, to secure the box to a chassis, may be formed on the sides thereof. In addition, it is preferred that the fuse receptacles be set to one side on one face of the body and the relay receptacles placed to the side away from the fuse receptacles and on the opposite face of the body. In a particularly preferred form of the Invention, the receptacles near the relay receptacles are for the circuits in which the current flows intermittently. This reduces the possibility of overheating (and hence premature failure) of the fuses.

BRIEF DESCRIPTION OF THE DRAWINGS

In the accompanying drawings, constituting a part hereof and in which like reference characters indicate like parts.

DESCRIPTION OF THE PREFERRED EMBODIMENTS

In the present Invention, the fuse receptacles and the relay receptacles are disposed on opposite faces of the box body. Therefore, even if the body is reduced in size, there is sufficient space for these elements. Moreover, according to a second embodiment of the Invention, if the mechanism for locking the body to the chassis is disposed on the lateral side(s), there is even more space for the fuse receptacles and the relay receptacles, thereby permitting an even greater reduction in size.

In a third embodiment of the Invention, the relay receptacles and the fuse receptacles are located at the opposite sides of their respective faces; thus, even if the relays become hot, the heat conveyed to the fuses is minimized. This reduces the chances of malfunction of the fuses due to overheating. By positioning the fuses carrying intermittent current near the relays and the fuses carrying continuous current remote therefrom, the opportunity for failure of the fuses due to heat generated by the relays is further reduced.

Accordingly, it is possible to make the entire system small, while the necessary areas for fuse receptacles and the relay receptacles are easily provided. Further, with particular regard to the second embodiment of the Invention, because the junction box is mounted on the chassis at lateral side of the body, still more space is available for the fuse receptacles and the relay receptacles, thereby permitting further miniaturization of the system.

DETAILED DESCRIPTION OF THE INVENTION

Figure 1:
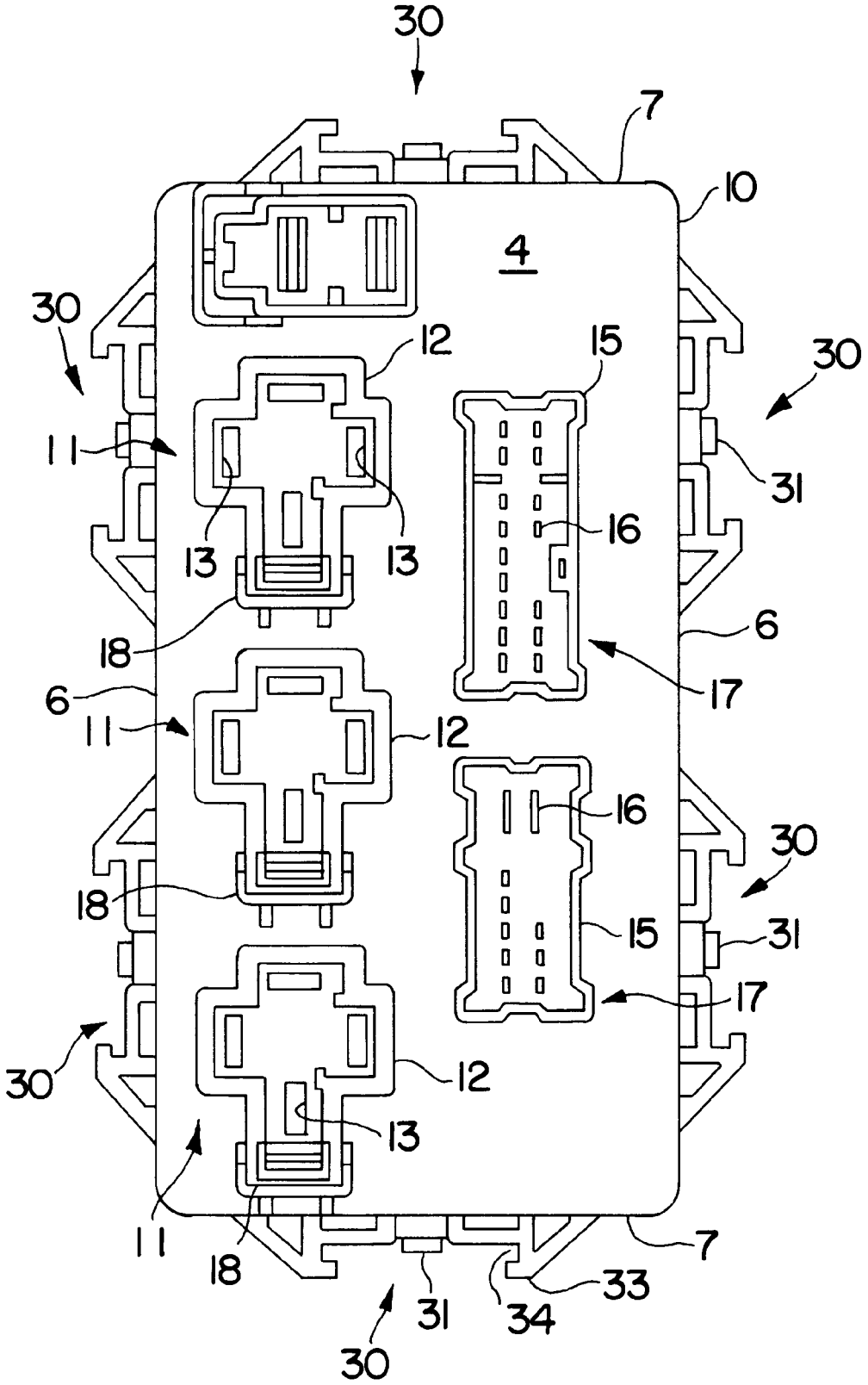
FIG. 1 is a plan view of the junction box of the present Invention.
Figure 2:
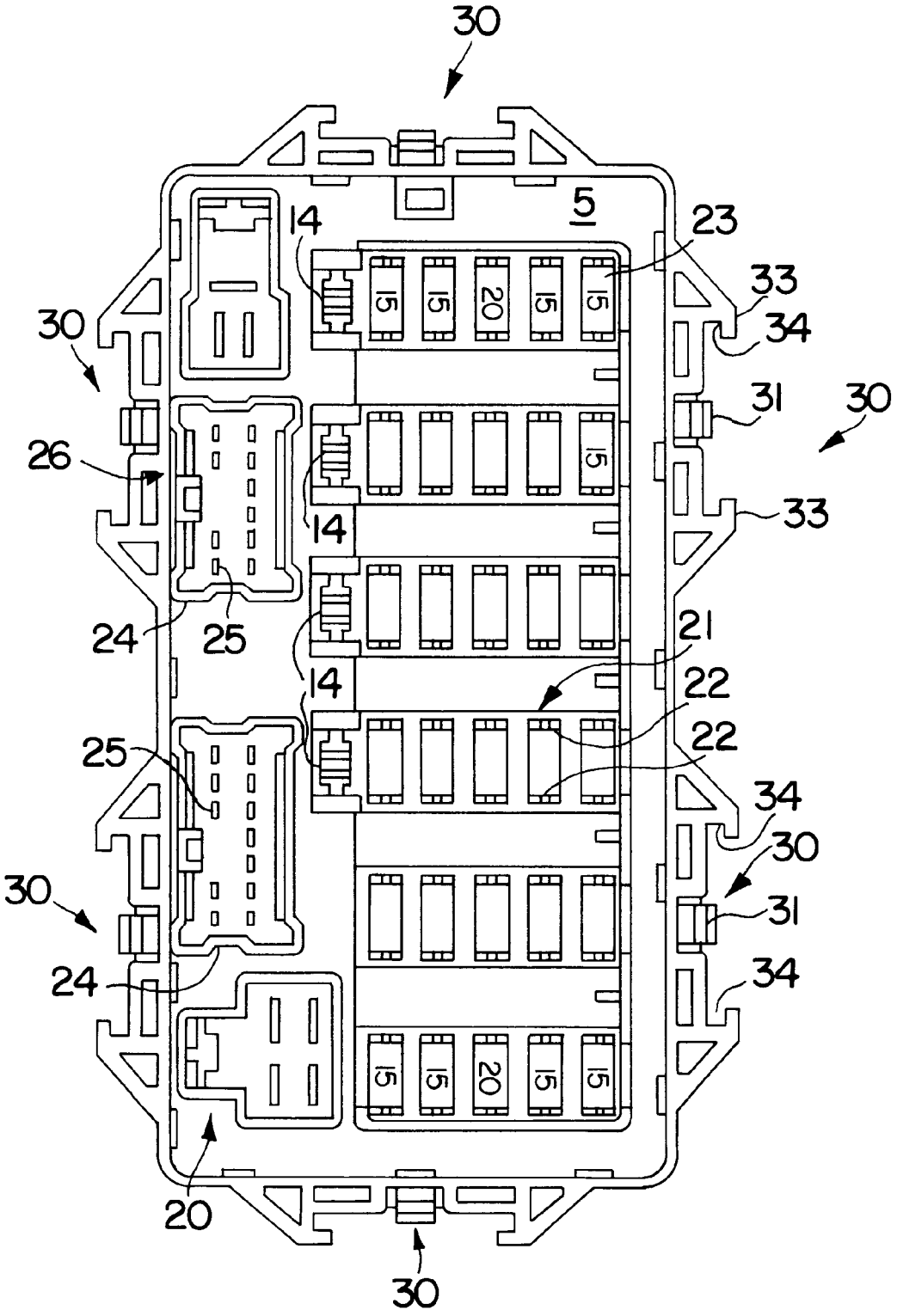
FIG. 2 is a bottom view of the junction box of FIG. 1.
Figure 3:
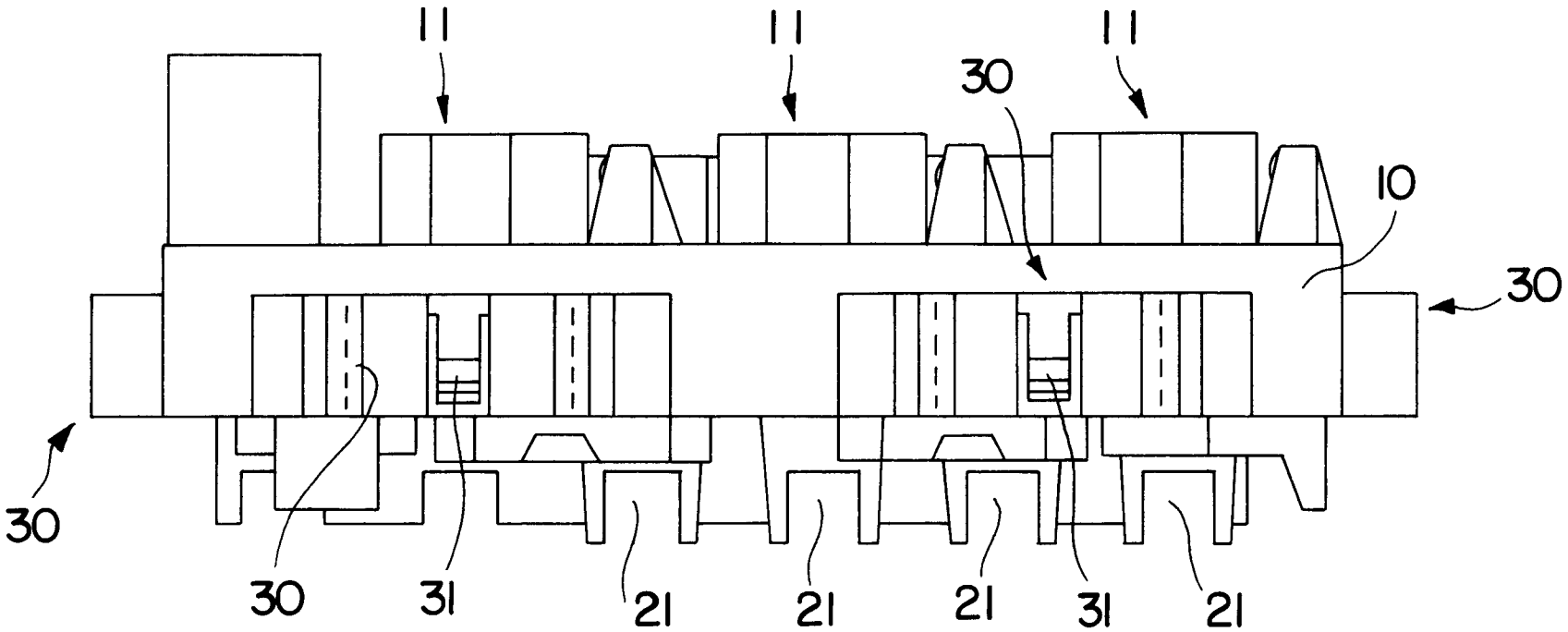
FIG. 3 is a side view of the junction box of FIG. 1.

FIG. 1 is a plan view of the junction box according to this embodiment, FIG. 2 shows the bottom face, and FIG. 3 is a side elevation. As will be apparent from these figures, body 10 of the junction box forms a flat rectangular parallelepiped. Though not illustrated, inside body 10, there is disposed an electrically conductive part formed by punching out a metal plate, in a well known manner.

Referring more specifically to FIGS. 1–3, one face 4 of body 10 carries three relay receptacles 11 upstanding therefrom, preferably integral therewith. Each relay receptacle 11 has wall 12 for insertion of a housing for a relay having a connector (not illustrated). In wall 12 are formed four insertion holes 13 adapted to receive the male terminal fittings of the relay. Each group of relay receptacles 11 is arranged in a single row set to the left side (as shown in FIG. 1) on face 4 of body 10. On the right side of face 4 are provided two male connectors 17 comprising male terminals 16 projecting from face 4 within hood 15. Lock protector 18 of the relay housing is integral with insertion walls 12 of relay receptacles 11.

On opposite bottom face 5 (the reverse side) of box body 10, there is provided a large number of fuse receptacles 21, as shown in FIG. 2. This construction is formed by arranging a pair of opposed fuse terminals 22 to permit insertion of fuse 23 therebetween. In this embodiment, fuse receptacles 21 are spaced toward the lateral side of body 10 (to the right in FIG. 2) opposite to the lateral side toward which the relay receptacles are located on face 4. While the fuse receptacles are, as a whole, apart from relay receptacles 11, there may be some fuses 23 which are relatively near thereto. Accordingly, in a preferred form of the device, those fuses carry current which flows intermittently, such as, for example, for the rear windshield wiper, rear defroster, or air bag. In a most preferred form of the Invention, spare fuses 14 are located between fuses 23 and relay receptacles 11, thereby insuring that fuses 23 are unaffected by current flowing through the relays. Further, on the left side of face 5, there are four male connectors 26 comprising male terminals 25 projected upwardly from face 4 within hoods 24.

Figure 4:
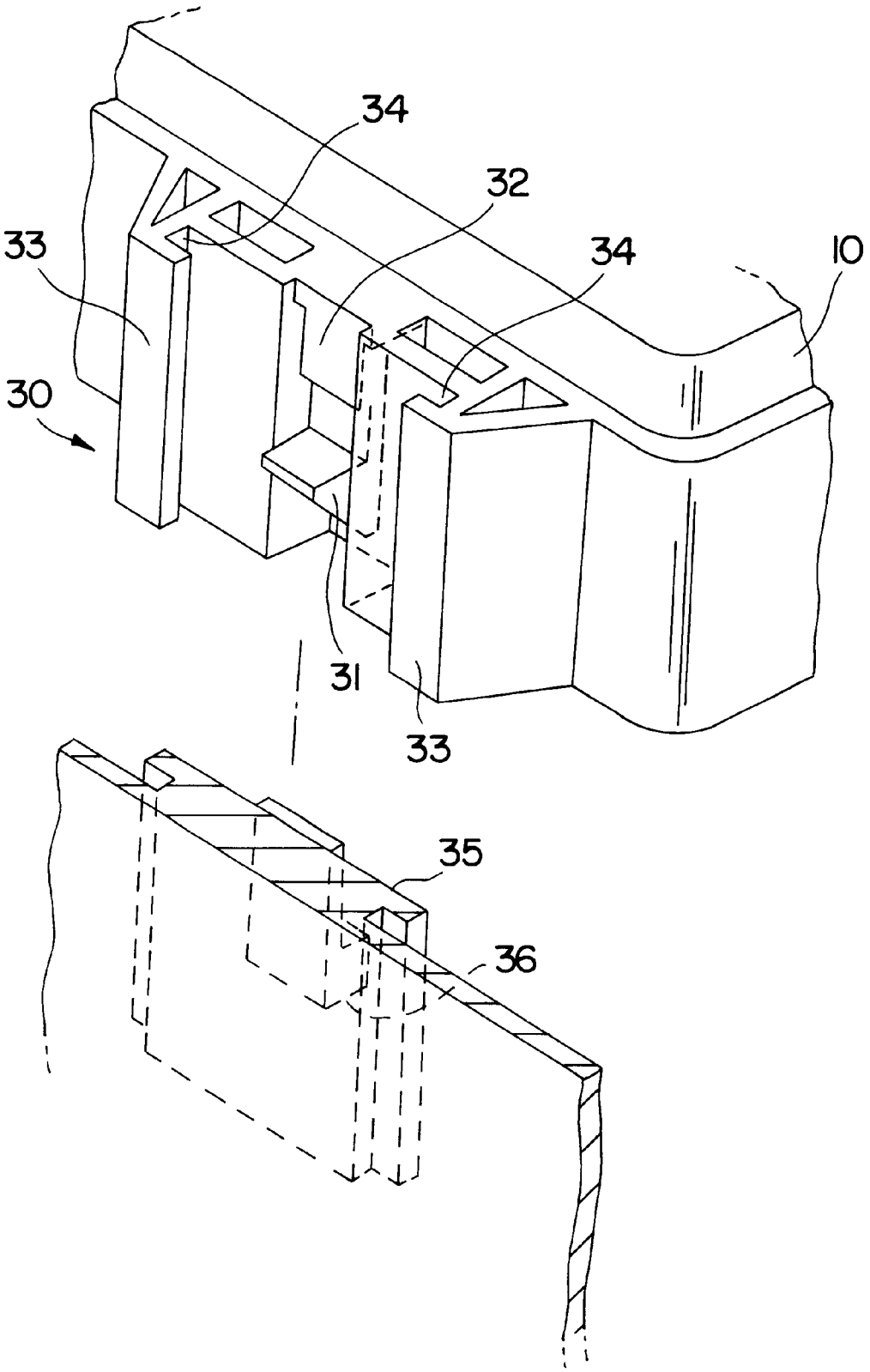
FIG. 4 is an enlarged perspective view of the locking mechanism for mounting the junction box on a base.
Figure 5:
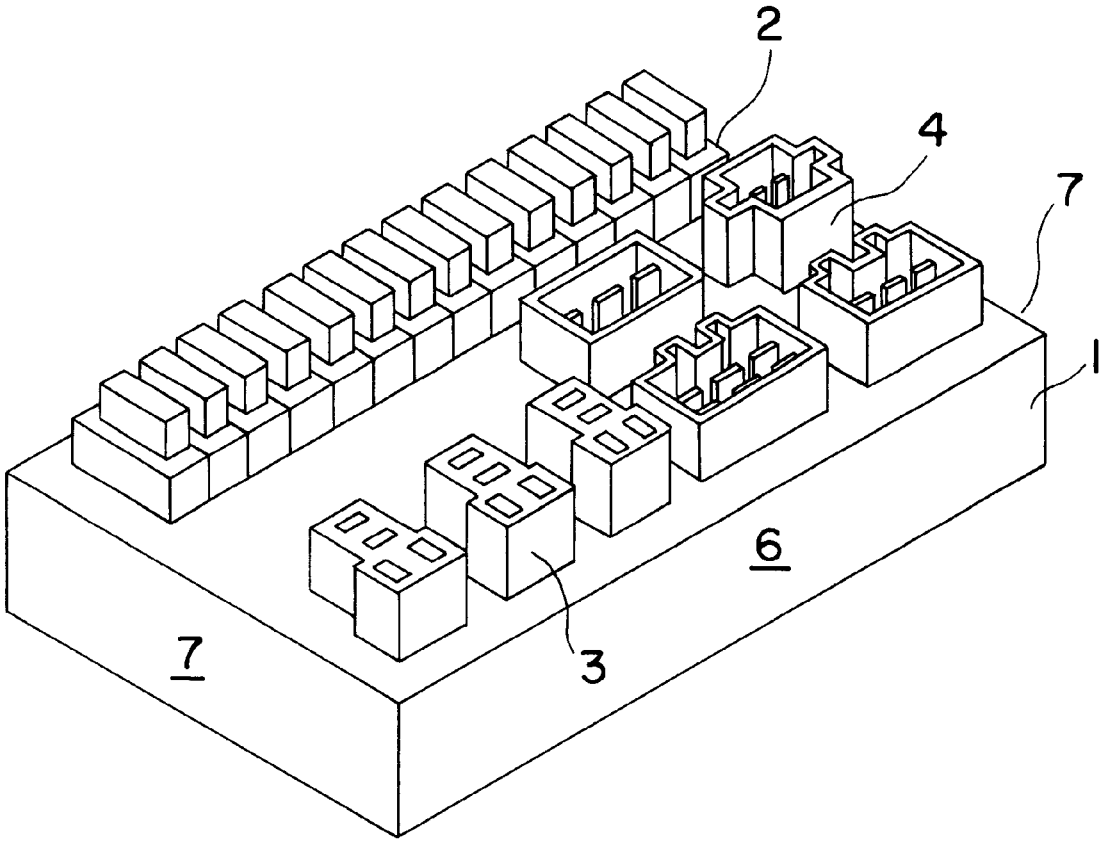
FIG. 5 PRIOR ART
FIG. 5 is a perspective view of a conventional junction box.

On the four lateral sides of body 10, there are locking members 30 for securing the junction box to a chassis (not shown). Preferably, these are two sets on each side 6 and one set on each end 7. Each of locking members 30 comprises integrally molded resilient tongue 32 which is spaced from the adjacent lateral side or end of body 10, and has engaging claw 31 at its tip. A pair of retainers 33 project on the two sides thereof, as shown in FIG. 4. Retainers 33 form opposed guide grooves 34, in which the two edges of fixed slider 35 are inserted. At the center of fixed slider 35 there is an integral projecting stop 36, which engages claw 31 of locking member 30. Accordingly, when body 10 is moved downward as shown in FIG. 4, slider 35 is inserted into guide groove 34 of locking member 30 and, when the junction box and chassis are fully matched, stop 36 directly contacts the inclined face of claw 31 to cause tongue 32 to deform elastically toward the adjacent lateral side or end of body 10, whereby stop 36 passes over claw 31, thereby locking the junction box to the chassis.

Thus, it is possible to utilize both face 4 and face 5 of body 10 as areas for relay receptacles 11 and fuse receptacles 21. For this reason, when compared with the conventional structure which locates both the relay receptacles and the fuse receptacles on one side only, the utilization efficiency is improved and it becomes possible to make the entire body 10 small in size, yet retaining the space necessary to include fuse receptacles 21 and relay receptacles 11. Moreover, as locking members 30 are formed on the lateral sides and ends of body 10, it is possible to utilize both faces 5 and 6 more efficiently, further contributing to miniaturization of the system.

Preferably, relay receptacles 11 and fuse receptacles 21 are opposite lateral sides on faces 4 and 5, respectively. Therefore, the relays and the fuses are spaced apart. For this reason, even when generation of heat is unavoidable (as in the relay for power supply), the heat conveyed to fuses 23 from the relays can be kept to a minimum, and malfunction of fuses 23 at a level lower than the rated current, resulting from excess heat from the relay, can be prevented. Moreover, particularly when fuses 23, which are closest to relay receptacles 11, are for the circuits in which the current flow is intermittent, the thermal effect is further reduced. Therefore, fuses 23, which carry a flow of continuous current are positioned farthest from relay receptacles 11, thereby increasing the effectiveness of the heat control of the present Invention.

It is to be understood that the present Invention is not limited to the embodiments described and illustrated in the foregoing description and drawings, but may be practiced under various modifications without going beyond the scope thereof. While only a specific number of embodiments of the present Invention have been expressly disclosed, it is, nonetheless, to be broadly construed and not to be limited except by the character of the claims appended hereto.

What we claim is:

1. A junction box having a first face and, spaced apart therefrom, a second face, a first side extending between said first face and said second face, a second side extending between said first face and said second face, said second side spaced apart from said first side, a first surface extending between said first face and said second face and at a first angle other than 0° and 180° to said first side and said second side, a second surface extending between said first face and said second face, spaced apart from said first surface and at a second angle other than 0° and 180° to said first face and said second face, said first face, said second face, said first side, said second side, said first surface, and said second surface defining a six sided body, an electrically conductive element on said body, at least one fuse on said first face, and at least one relay on said second face, at least one spare fuse between said relay and said fuse.

2. The junction box of claim 1 wherein said first face is substantially parallel to said second face.

3. The junction box of claim 2 wherein said first side is parallel to said second side and said first surface is parallel to said second surface.

4. The junction box of claim 3 wherein said first angle and said second angle are the same.

5. The junction box of claim 4 wherein said first angle and said second angle are approximately 90°.

6. The junction box of claim 1 comprising at least one locking member on at least one of said said first side, said second side, said first surface, and said second surface.

7. The junction box of claim 6 wherein said locking member comprises a tongue substantially parallel to an adjacent area of said first side, said second side, said first surface, or said second surface, and spaced apart therefrom at its distal end, a claw on said distal end and having a plane slanted toward said adjacent area in an engaging direction, a pair of guide grooves, facing each other, adjacent said tongue and substantially parallel thereto, said pair of guide grooves adapted to slidably receive a slider fixed on a base, said slide entering said guide grooves as said locking member is moved toward said slider in said engaging direction.

8. The junction box of claim 7 wherein said slider, as said locking member moves in said engaging direction, rides up said plane, causing said claw to flex toward said area, a stop on said slider whereby, when said stop passes said claw in said engaging direction, said claw moves away from said area and bears against said stop, thereby retaining said body on said base.

9. The junction box of claim 6 wherein there is at least one said locking member on each of said first side, said second side, said first surface, and said second surface.

10. The junction box of claim 9 wherein said first side and said second side are each longer than said first surface and said second surface, there being two said locking members on each of said first side and said second side.

11. The junction box of claim 10 wherein there is one said locking member on each of said first surface and said second surface.

12. The junction box of claim 1 wherein the fuses near said relay receptacles are electrically connected to circuits through which electric current does not flow continuously.

13. The junction box of claim 1 wherein there are a plurality of fuse receptacles, a plurality of relays, and a plurality of spare fuses between said relays and said fuses.

* * * * *